US010104942B2

(12) United States Patent
Miller

(10) Patent No.: US 10,104,942 B2
(45) Date of Patent: Oct. 23, 2018

(54) SURVIVAL BELT BUCKLE

(71) Applicant: Ronald Miller, Port Orchard, WA (US)

(72) Inventor: Ronald Miller, Port Orchard, WA (US)

( * ) Notice: Subject to any disclaimer, the term of this patent is extended or adjusted under 35 U.S.C. 154(b) by 103 days.

(21) Appl. No.: 15/196,455

(22) Filed: Jun. 29, 2016

(65) Prior Publication Data

US 2018/0000201 A1 Jan. 4, 2018

(51) Int. Cl.

| | |
|---|---|
| ***F23Q 1/02*** | (2006.01) |
| ***A44B 11/00*** | (2006.01) |
| ***A44B 11/22*** | (2006.01) |
| ***F23Q 1/06*** | (2006.01) |
| ***A41F 9/00*** | (2006.01) |

(52) U.S. Cl.

CPC ..... *A44B 11/005* (2013.01); *A41F 9/002* (2013.01); *A44B 11/006* (2013.01); *A44B 11/22* (2013.01); *F23Q 1/06* (2013.01)

(58) Field of Classification Search

CPC ..... F23Q 1/06; A44B 11/005; A44B 11/266; A44B 11/2592; A44B 11/2534

USPC ..... 431/262, 276–274, 273–276

See application file for complete search history.

(56) References Cited

U.S. PATENT DOCUMENTS

| | | | | |
|---|---|---|---|---|
| 995,463 | A | 6/1911 | Hubert | |
| 3,402,029 | A | 9/1968 | Sampson, Jr. III | |
| 4,078,272 | A | 3/1978 | Mahon, III | |
| 4,672,745 | A | 6/1987 | Wilkens | |
| 4,698,068 | A | 10/1987 | Jensen | |
| 4,753,377 | A * | 6/1988 | Poluhowich | A44B 11/005 2/338 |
| 5,217,150 | A | 6/1993 | Chen | |
| 5,279,628 | A | 1/1994 | Hutchens et al. | |
| 5,919,037 | A | 7/1999 | Brillhart, III et al. | |
| 8,056,780 | B1 | 11/2011 | Bruns | |
| 8,186,995 | B2 | 5/2012 | Putrello, Jr. | |
| 8,202,085 | B2 | 6/2012 | Putrello | |
| 8,312,602 | B2 | 11/2012 | Paik | |
| 8,348,539 | B2 | 1/2013 | Chu et al. | |
| D679,141 | S | 4/2013 | Slack | |
| 2005/0127630 | A1 | 6/2005 | Kuhlman et al. | |
| 2015/0135768 | A1* | 5/2015 | Barrick | A44C 15/005 63/1.12 |
| 2017/0360159 | A1* | 12/2017 | Anderson | A44B 11/005 |

* cited by examiner

*Primary Examiner* — Vivek Shirsat
(74) *Attorney, Agent, or Firm* — Dean A Craine, P.S.

(57) ABSTRACT

A survival belt buckle configured to be worn around the user's waist that may make a fire under different environmental conditions. The belt buckle includes a rigid body made of high carbon steel. The body includes a plurality of striking points that when stuck against a flint, chert rock, or quartz produces a spark to ignite dry tinder or other combustible material. On a perimeter edge of the body is a ferrocerium rod that can be used with a steel knife or stone to produce spark. Also, on a perimeter edge of the body is a magnesium bar that produces small shavings that can be ignited. Also, in the rigid body is a magnifying lens used to ignite tinder with sun rays. The belt buckle is waterproof, easily transported and can be use with a knife, hard stone, other metal pieces, or with similar belt buckles worn by others.

4 Claims, 2 Drawing Sheets

SURVIVAL BELT BUCKLE

Notice is given that the following patent document contains original material subject to copyright protection. The copyright owner has no objection to the facsimile or digital download reproduction of all or part of the patent document, but otherwise reserves all copyrights.

BACKGROUND OF THE INVENTION

1. Field of the Invention

This invention pertains to outdoor survival equipment, and more particularly to survival equipment used to make a fire and is easily portable.

DESCRIPTION OF THE RELATED ART

When living outdoors for extended time periods, the ability of build a fire without matches is very important. One way is to use a flint stone and a piece of steel. By scraping the piece of steel, such as a blade of knife, against the flint stone, sparks are produced that can ignite a dry tinder nest. Unfortunately, if a flint stone, a piece of steel, or dry tinder are rarely available, making a fire can be difficult.

Another problem with using a flint stone and piece of steel is that they are normally carried in a backpack or pocket and can be easily broken or lost.

What is needed is a rigid, planar-shaped belt bucket that can be easily worn around the waist of a user that can make a fire under different environmental conditions.

SUMMARY OF THE INVENTION

These and other objects are met by a fire producing survival belt buckle disclosed herein configured to be used with a belt and worn around the user's waist or shoulder. The belt buckle is configured to make fire under different environmental conditions and when different materials are available.

The belt buckle includes a rigid body made of high carbon steel. The body includes a plurality of sharp striking points that when stuck against a flint, chert rock, or quartz to produce a spark to ignite dry tinder or other combustible material. On a perimeter edge of the body is a ferrocerium rod that can be used with a steel knife or stone to produce spark. Also located on another perimeter edge of the body is a magnesium bar that produces small shavings that can be ignited. Also, attached or mounted on the rigid body is a magnifying lens used to ignite tinders with sun rays.

All of the components used to make the belt buckle are durable and waterproof. Because the belt buckle can be attached to the user's waist, it is securely attached to the body at all times and may be easily transported in a hands free mode. It may be used to make fire using a knife with a steel blade, a hard stone, other metallic pieces. It may also be used with similar belt buckles worn by others.

The belt buckle may be securely attached to one end of a waist or shoulder belt and selectively attached to the opposite end of a belt.

DESCRIPTION OF THE PREFERRED EMBODIMENT(S)

Figure 1:
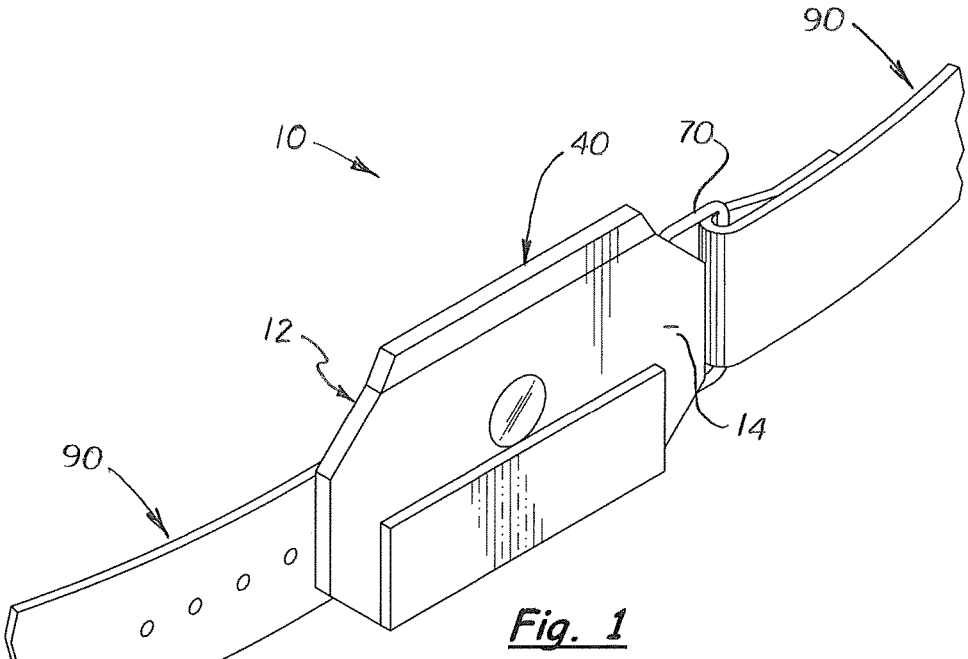
FIG. 1 is a perspective view of the fire producing survival belt buckle and belt.
Figure 2:
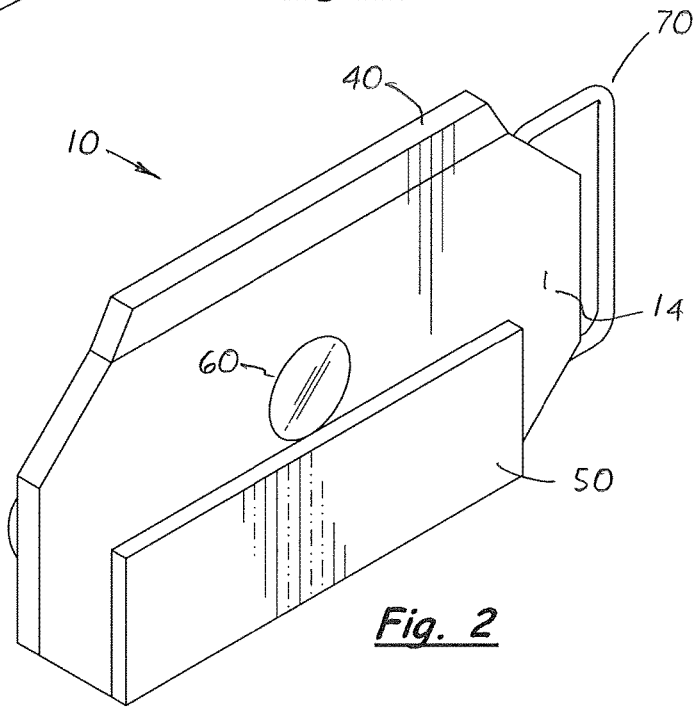
FIG. 2 is a perspective view of the belt buckle.
Figure 3:
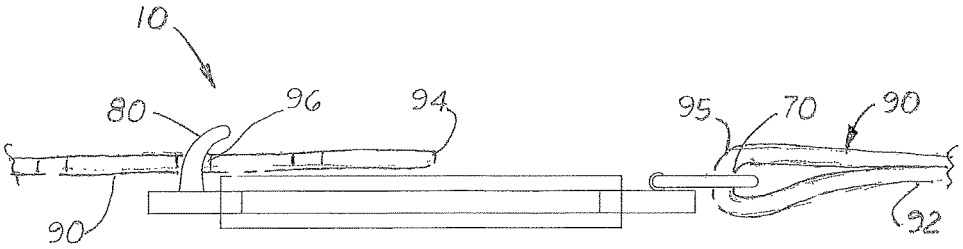
FIG. 3 is a top plan view of the belt buckle.
Figure 4:
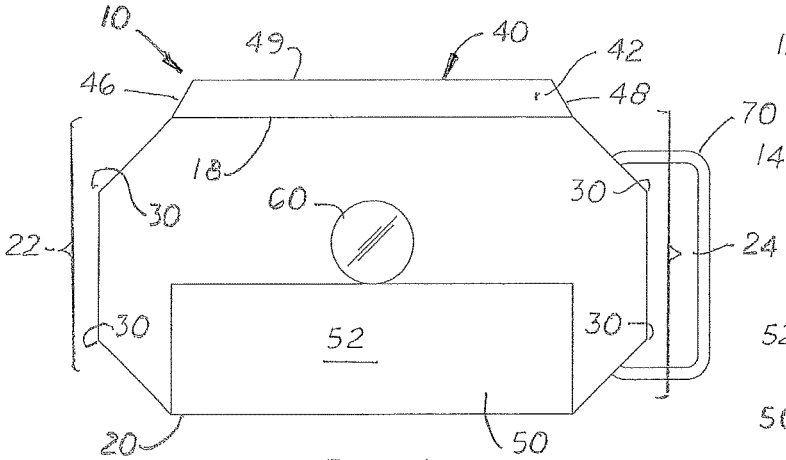
FIG. 4 is a front elevational view of the belt buckle.
Figure 6:
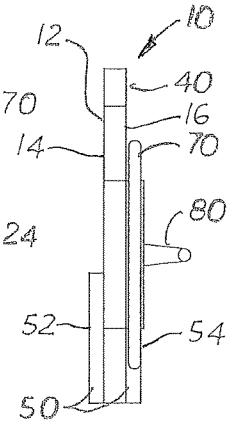
FIG. 6 is an end elevational view of the belt buckle.
Figure 5:
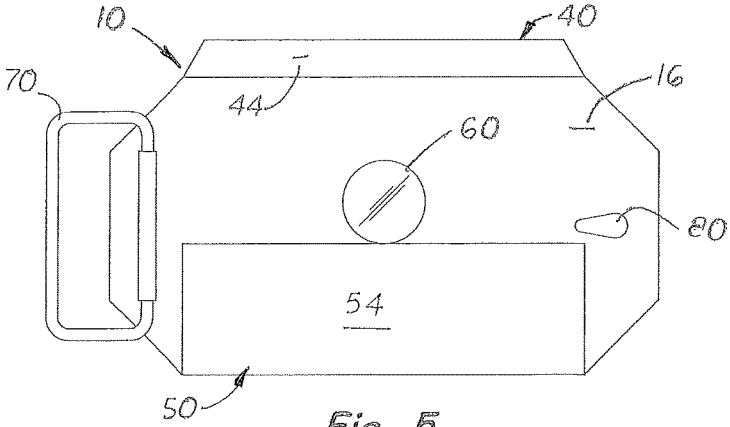
FIG. 5 is a rear elevational view of the belt buckle.

A fire producing survival belt buckle 10 used to make a fire under different environmental conditions. The belt buckle 10 is made of durable material, waterproof, and used with a belt worn around the user's waist or shoulder for easily portability.

The belt buckle 10 includes a rigid body 12 made of high carbon steel. The rigid body 12 is a planar structure with a front surface 14, a rear surface 16, a top surface 18, and a lower cutout 20. The opposite side perimeter edges 22, 24 of the rigid body 12 include a plurality of sharp striking points 30 that when stuck against a flint, chert rock, or quartz produces a spark to ignite dry tinder or other combustible material.

Mounted on the top surface 18 of the rigid body 12, is a ferrocerium rod 40 that can be used with a steel knife or stone to produce sparks. In the embodiment shown, the ferrocerium rod 40 is mounted directly on the top surface 18 so that its front surface 42, rear surface 44, the two diagonal side edges 46, 48 and the top surface 49 are exposed.

Mounted inside the cutout 20 is a rectangular shaped magnesium bar 50. The magnesium bar 50 includes a front surface 52, and a rear surface 54 and a lower surface 56. The front surface 52 and the rear surface 54 protrude from the rigid body's front and rear surfaces, 14, 16, respectively. During use, the magnesium bar 50 may be scrapped with a steel knife blade to produces small shavings that can be ignited.

Mounted in the body 12 is a magnifying lens 60. When the rigid body 12 is held at a proper angle in sunlight, the magnifying lens may ignite tinders. In the Figs. the magnifying lens 60 is centrally in the rigid body 12. It should be understood however, that the lens 60 may be located any location on the rigid body 12.

In the embodiment shown herein, the rigid body 12 includes at least one lateral extending side loop 70 that attaches to a loop 95 formed or attached to the distal end 92 on a belt 90. Formed on the rear surface 16 near the opposite side edge of the rigid body 12 is a rearward projecting hook 80 configured to be inserted into a hole 96 formed on the proximal end 94 of the belt 90.

In the embodiment in the Figs., the belt buckle 10 measures 2 to 4 inches in length and 1 to 3 inches in height. The rigid body 12 is approximately ⅛ to ½ inches thick. The ferrocerium rod 40 is elongated and rectangular in cross-section and longitudinally aligned with the rigid body 12. The ferrocerium rod 40 measures 1 to 3 inches in length, ¼ to 1 inch in height and ⅛ to 1 inch thick. The magnesium bar 50 is also rectangular in cross section and longitudinally aligned with the rigid body 12. The magnesium bar 50 is parallel to and approximately the same length as the ferrocerium rod 40. In the embodiment shown in the Figs, the magnesium bar 50 is slightly thicker than the rigid body 12 and the ferrocerium rod 40. It should be understood however, that the belt buckle 10 is not limited to these dimensions nor are the ferrocerium rod 40 and magnesium bar 50 required to be located at the locations on the rigid body 12, or have the sizes and shapes listed above. Also, it should also be understood that the number and location of the sharp striking points 30 of the perimeter edges 22, 24 of the rigid body 12 is not limited by the embodiment in the Figs. The magnifying lens 60 is made of transparent plastic or glass approximately ½ to 2 inches in diameter. In the preferred embodiment, the magnifying lens is 6× power. It should also be understood that the magnifying lens 60 may be located at any location of the rigid body 12.

During use, the rigid body 12 may be used against a hard stone (flint, chert stone, quartz, etc) to ignite various tinders. Alternatively, the ferrocerium rod 40 may be struck with the steel blade on a knife or hard stone to ignite tinders. If dry combustible tinder is not available, the blade of a knife may be used to produce shavings from the magnesium bar 50 that can be used to create a chemical fire that may be used to ignite tinders. Also, magnifying lens 60 may be used to concentration sunlight by holding the rigid body so that the magnifying lens is normal to the sun rays.

In compliance with the statute, the invention described has been described in language more or less specific as to structural features. It should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

I claim:

1. A survival belt buckle, comprising:

a. a single rigid body 12 made of high carbon steel, said rigid body 12 being a planar structure with a flat front surface 14, a rear surface 16, a top surface 18, a lower cutout 20, and opposite side perimeter edges 22, 24, formed on said side perimeter edges are a plurality angled striking points 30 configured to produce a spark when stuck with sufficient force against a flint, chert rock, or quartz;

b. a ferrocerium rod 40 attached to said top surface 18 of said rigid body 12;

c. a magnesium bar 50 mounted inside said lower cutout 20, said magnesium bar 50 includes a front surface 52 that protrudes from said front surface 14 of said rigid body 12 and a rear surface 54 that protrudes from said rear surface 16 of said rigid body 12 when said magnesium bar 50 is mounted inside said lower cutout 20;

d. a magnifying lens 60 mounted on said rigid body 12 configured to ignite combustible tinder when exposed at a suitable angle to sunlight;

e. a side loop 70 attached to rigid body 12 near one side perimeter edge 22; and f. a hook 80 attached to said rigid body 12 near the opposite side perimeter edge 24 from said side loop 70.

2. The survival belt buckle as recited in claim 1, wherein said ferrocerium rod 40 is attached to said top surface 18 of said rigid body 12, said ferrocerium rod 40 is a rectangular in cross-section with a planar front surface 42, a planar rear surface 44, two end surfaces 46, 48, and a planar top surface 49.

3. The survival belt buckle as recited in claim 1, wherein said magnifying lens 60 is centrally located in said rigid body 12.

4. The survival belt buckle as recited in claim 1, further including a belt 90 with a loop 95 formed on one end 92 that attaches to said side loop 70 on said rigid body 12 and a plurality of longitudinally aligned holes 96 formed on an opposite end 94 of said belt 90, each hole 96 configured to receive said hook 80 on said rigid body 12 to hold said belt 90 around a user's waist or shoulder.

* * * * *